US007530236B2

(12) United States Patent
Nanda

(10) Patent No.: US 7,530,236 B2
(45) Date of Patent: May 12, 2009

(54) NATURAL GAS LIQUID RECOVERY

(76) Inventor: Rajeev Nanda, Technip USA Corp 11700, Old Katy Rd., Suite 150, Houston, TX (US) 77079

( * ) Notice: Subject to any disclaimer, the term of this patent is extended or adjusted under 35 U.S.C. 154(b) by 443 days.

(21) Appl. No.: 11/366,484

(22) Filed: Mar. 1, 2006

(65) Prior Publication Data

US 2007/0204651 A1 Sep. 6, 2007

(51) Int. Cl.
*F25J 3/00* (2006.01)

(52) U.S. Cl. ..... 62/625; 62/634

(58) Field of Classification Search ..... 62/620, 62/630, 625, 634

See application file for complete search history.

(56) References Cited

U.S. PATENT DOCUMENTS

| | | | | |
|---|---|---|---|---|
| 5,114,451 | A * | 5/1992 | Rambo et al. | 62/623 |
| 5,442,924 | A | 8/1995 | Tsai et al. | |
| 6,662,589 | B1 * | 12/2003 | Roberts et al. | 62/425 |
| 7,155,931 | B2 * | 1/2007 | Wilkinson et al. | 62/620 |
| 2006/0000234 | A1 * | 1/2006 | Cuellar et al. | 62/620 |
| 2006/0260355 | A1 * | 11/2006 | Roberts et al. | 62/620 |

* cited by examiner

*Primary Examiner*—William C Doerrler
(74) *Attorney, Agent, or Firm*—O'Neill & McConnell, PLLC; R. Perry McConnell

(57) ABSTRACT

An apparatus and process for removing natural gas liquids from an liquid natural gas (LNG) stream, specifically recovering at least 90% of ethane from the LNG, utilizing the low-level heat available in an LNG terminal.

29 Claims, 1 Drawing Sheet

NATURAL GAS LIQUID RECOVERY

FIELD OF THE INVENTION

The invention pertains to efficient recovery of natural gas liquids, particularly ethane, from liquid natural gas.

BACKGROUND OF THE INVENTION

Natural gas is often transported in the form of liquid natural gas ("LNG"). LNG usually is primarily composed of methane, but also comprises lesser amounts of heavier hydrocarbons, such as ethane, propane, and heavier hydrocarbons. When LNG is off-loaded at a terminal, it is often desirable to separate ethane or other heavier hydrocarbons from the LNG in the form of natural gas liquids ("NGL"). The separated NGL can be treated as Y-grade product, or can be further processed in a deethanizer to produce both an ethane product and a Y-grade product.

However, it is also desirable to reduce the power consumption involved in separating NGL from LNG. This process typically requires a flash absorber and a demethanizer. LNG terminals will typically have low level heat available for reboiling, therefore it is desirable to operate the demethanizer at a lower than normal pressure to efficiently utilize the available energy.

It is desirable to use a cooled portion of the LNG product stream to reflow to the flash absorber. Additionally, to operate the demethanizer at a lowered pressure, it is desirable to use a portion of the LNG product stream to reflow to the demethanizer to aid in the removal of NGL from the LNG. Demethanizer feed preheaters and side reboilers are desirably utilized to reduce the duty cycle of the demethanizer bottom reboiler.

It is an object of the invention to separate NGL from LNG in a cost-effective process.

It is a further object of the invention to separate NGL from LNG using a demethanizer at a relatively low pressure.

It is yet another object of the invention to efficiently recover at least 90% of the ethane from a LNG feed.

SUMMARY OF THE INVENTION

The invention is an apparatus and process for separating NGL from LNG at a LNG terminal, in particular allowing recovery of at least 90% of the ethane from the LNG feed in a cost-efficient manner. At the process inlet, the LNG feed is preferably routed through a heat exchanger for use in condensing the LNG product stream. This heat exchanger may be partially bypassed, if necessary. The LNG feed is then delivered to a flash absorber allowing initial separation of NGL, particularly ethane, from the LNG feed. The bottom product of the flash absorber is removed, heated, and routed into a demethanizer. Overhead product from the flash absorber is compressed and becomes one part of the LNG product stream.

Heating the bottom product from the flash absorber and use of a side reboiler in the demethanizer provides greater energy efficiency and reduction of the duty cycle of the demethanizer bottom reboiler from what would be otherwise required. Bottom product of the demethanizer is the NGL product stream, which can be further processed in a deethanizer to produce an ethane product stream, or simply be metered out as Y-grade product.

Overhead product of the demethanizer is combined with the compressed overhead product of the flash absorber to form the LNG product stream. This LNG product stream is condensed, preferably by heat exchange with the LNG feed, as discussed above. A first portion of the LNG product stream is cooled and used as a first reflow stream into the flash absorber. A second portion of the LNG product stream is optionally cooled and used as a second reflow stream into the demethanizer. Use of these first and second reflow streams increase the separation of NGL from the LNG, and allow the demethanizer to be operated at a reduced pressure from what would otherwise be required.

By utilizing the first and second reflow streams, recovery of at least 90% of the ethane in the LNG feed is possible in a cost-effective and energy-efficient manner.

DETAILED DESCRIPTION

Figure 1:
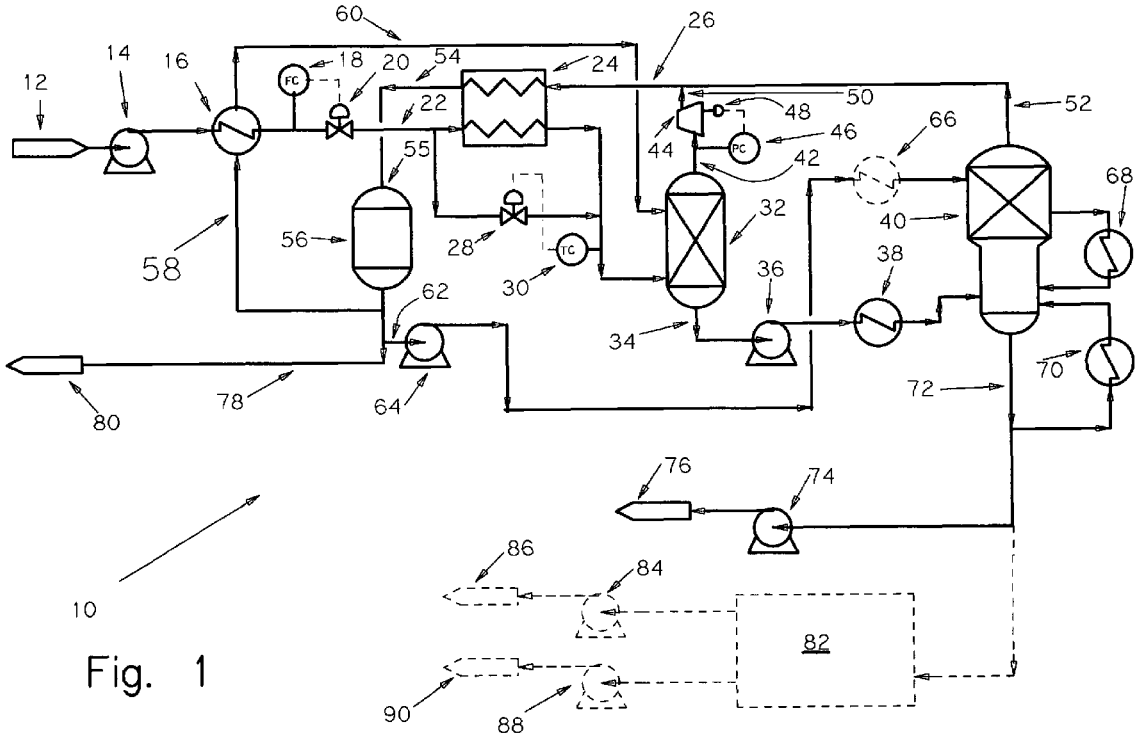
FIG. 1 is a schematic representation of one embodiment of the invention.

Referring to FIG. 1, a schematic representation of an embodiment of the invention and depicting its process is shown. An LNG processor 10 comprises an LNG inlet 12. LNG from LNG inlet 12 is fed to LNG feed pump 14, from which the LNG passes to feed preheater 16. Flow of the LNG into the LNG processor 10 is managed by flow controller 18, which detects flow of LNG and controls flow valve 20. The LNG inlet stream 22 then passes through heat exchanger 24, which provides heat exchange between the LNG inlet stream 22 and the LNG product stream 26, condensing the LNG product stream 26, and partially vaporizing the LNG inlet stream 22. Heat exchanger 24 may be a brazed aluminum type heat exchanger, a shell and tube heat exchanger, or another type of heat exchanger appropriate to the application.

On exiting heat exchanger 24, the LNG inlet stream passes to the flash absorber 32. Bypass valve 28 is controlled by temperature controller 30, maintaining the appropriate temperature of inlet stream 22 as it feeds into flash absorber 32. Flash absorber 32 preferably operates at approximately 195 to 210 psia and within a temperature range of −160 to −175° F.

Absorber bottom product 34 from the flash absorber 32 contains a high proportion of NGL, particularly ethane, relative to the content of the LNG inlet stream 22. Absorber bottom product 34 is fed to the demethanizer feed pump 36, which pumps absorber bottom product 34 through the demethanizer feed preheater 38 and into demethanizer 40. Demethanizer 40 operates in a range of approximately 270 to 290 psia at top and temperature ranges of approximately −130 to −165° F. at top and +18 to +65° F. at bottom. Bottom temperature in demethanizer 40 is controlled by regulating side reboiler 68 and bottom reboiler 70. Typical heat sources available for such reboilers in LNG terminals is in the operating temperature range of approximately 70 to 90° F. The heating media can be a mixture of ethylene glycol and water, propylene glycol and water, or other combinations of heating fluids commercially available and known to those skilled in the art.

Absorber overhead product 42 from the flash absorber 32 is compressed by compressor 44 to within a range of approximately 280-300 psia. Compressor 44 is controlled by pressure controller 46, which controls the pressurization control 48 on the compressor 44. Compressed absorber overhead product 50 from the flash absorber 32 is joined with demethanizer overhead product 52 to form LNG product stream 26. As discussed above, LNG product stream 26 is passed through heat exchanger 24 and condensed. Condensed LNG product stream 54 feeds into LNG surge drum 56 at LNG product outlet 55. LNG surge drum 56 operates in a pressure range of approximately 260 to 280 psia and a temperature range of approximately −180 to −195° F. A first portion 58 of condensed LNG product stream 54 may be cooled by feed preheater 16. The cooled first portion 60 feeds into flash absorber 32 to increase absorption and separation of heavier hydrocarbons, particularly ethane, thus increasing the ethane concentration of the bottom product and increasing the methane concentration of the overhead product.

A second portion 62 of condensed LNG product stream 54 is pumped by LNG reflow pump 64, and may optionally be cooled by LNG reflow cooler 66, then feeds into demethanizer 40. LNG reflow cooler 66 may be used as a matter of convenience, but demethanizer feed preheater 38 and heat exchanger 24 may be utilized to provide adequate control of temperature conditions in demethanizer 40. As with the LNG reflow in flash absorber 32, use of LNG reflow in demethanizer 40 increases heavier hydrocarbon concentration in the demethanizer bottom product 72 and increases methane concentration in demethanizer overhead product 52 while allowing demethanizer 40 to operate at lower pressures than would otherwise be required. Side reboiler 68 and demethanizer feed preheater 38 allow reduced duty cycles in bottom reboiler 70.

Alternatively, reflow of either the first portion 58 or the second portion 62 of the condensed LNG product stream 54 may be omitted. If reflow of the first portion 58 of the condensed LNG product stream 54 is omitted, there will be no reflow to the flash absorber 32. If reflow of the second portion 62 of the condensed LNG product stream 54 is omitted, there will be no reflow to the demethanizer 40. In either case, the overall efficiency of the NGL recovery would be lessened relative to that available by using both reflows.

Demethanizer bottom product 72 may be pumped by NGL product pump 74 to NGL terminal 76 for delivery as Y-grade NGL product. Similarly, LNG product 78 is delivered to LNG terminal 80. An alternative treatment of the NGL product may be provided by delivering demethanizer bottom product 72 to a deethanizer 82 (details not shown) and using ethane delivery pump 84 and NGL delivery pump 88 to deliver ethane and Y-grade NGL product to ethane terminal 86 and Y-grade NGL product terminal 90 respectively.

Those of skill in the art will recognize that heat exchange relationships may be altered in the above description without departing from the spirit of the invention, so long as flow streams are heated and cooled appropriately to maintain desired operating conditions. Accordingly, selection of various flow streams used in heat exchangers as described above is a matter of engineering preference and efficiency.

The above examples are included for demonstration purposes only and not as limitations on the scope of the invention. Other variations in the construction of the invention may be made without departing from the spirit of the invention, and those of skill in the art will recognize that these descriptions are provide by way of example only.

I claim:

1. A process to recover natural gas liquids (NGL) from liquid natural gas (LNG), comprising the steps of feeding partially vaporized LNG to a flash absorber, operating said flash absorber at a pressure of less than approximately 210 psia, withdrawing bottom product from said flash absorber, heating said withdrawn bottom product, feeding said heated bottom product to a demethanizer, compressing overhead product from said flash absorber, forming an LNG product stream by combining said compressed overhead product from said flash absorber with overhead product from said demethanizer, condensing said LNG product stream, feeding a first portion of said condensed LNG product stream to said flash absorber to aid separation of NGL from LNG, feeding a second portion of said LNG product stream to said demethanizer to aid separation of NGL from LNG, and withdrawing NGL from said demethanizer.

2. A process to recover natural gas liquids (NGL) from liquid natural gas (LNG), comprising the steps of feeding partially vaporized LNG to a flash absorber, operating said flash absorber at a pressure of less than approximately 210 psia, withdrawing bottom product from said flash absorber, heating said withdrawn bottom product, feeding said heated bottom product to a demethanizer, compressing overhead product from said flash absorber, forming an LNG product stream by combining said compressed overhead product from said flash absorber with overhead product from said demethanizer, condensing said LNG product stream, feeding a first portion of said condensed LNG product stream to said flash absorber to aid separation of NGL from LNG, and withdrawing NGL from said demethanizer.

3. A process to recover natural gas liquids (NGL) from liquid natural gas (LNG), comprising the steps of feeding partially vaporized LNG to a flash absorber, operating said flash absorber at a pressure of less than approximately 210 psia, withdrawing bottom product from said flash absorber, heating said withdrawn bottom product, feeding said heated bottom product to a demethanizer, compressing overhead product from said flash absorber, forming an LNG product stream by combining said compressed overhead product from said flash absorber with overhead product from said demethanizer, condensing said LNG product stream, feeding a portion of said LNG product stream to said demethanizer to aid separation of NGL from LNG, and withdrawing NGL from said demethanizer.

4. The process of claim 1, wherein the step of feeding a first portion of said condensed LNG product stream to said flash absorber to aid separation of NGL from LNG, additionally comprises the steps of cooling a first portion of said condensed LNG product stream, and feeding said cooled first portion of said condensed LNG product stream to said flash absorber to aid separation of NGL from LNG.

5. The process of claim 2, wherein the step of feeding a first portion of said condensed LNG product stream to said flash absorber to aid separation of NGL from LNG, additionally comprises the steps of cooling a first portion of said condensed LNG product stream, and feeding said cooled first portion of said condensed LNG product stream to said flash absorber to aid separation of NGL from LNG.

6. The process of claim 1, wherein the step of feeding a second portion of said LNG product stream to said demethanizer to aid separation of NGL from LNG additionally comprises the steps of cooling a second portion of said condensed LNG product stream, and feeding said cooled second portion of said condensed LNG product stream to said demethanizer to aid separation of NGL from LNG.

7. The process of claim 3, wherein the step of feeding a second portion of said LNG product stream to said demethanizer to aid separation of NGL from LNG additionally comprises the steps of cooling a second portion of said condensed LNG product stream, and feeding said cooled second portion of said condensed LNG product stream to said demethanizer to aid separation of NGL from LNG.

8. Apparatus for recovering natural gas liquids (NGL) from liquid natural gas (LNG), comprising a flash absorber in fluid communication with an LNG inlet, wherein said flash absorber operates at a pressure of less than approximately 210 psia, a demethanizer in fluid communication with bottom product from said flash absorber, an LNG product outlet in fluid communication with top product from said flash absorber and said demethanizer, and an NGL product outlet in fluid communication with bottom product from said demethanizer, wherein said LNG product outlet is additionally in fluid communication with said flash absorber and said demethanizer.

9. Apparatus for recovering natural gas liquids (NGL) from liquid natural gas (LNG), comprising a flash absorber in fluid communication with an LNG inlet, wherein said flash absorber operates at a pressure of less than approximately 210 psia, a demethanizer in fluid communication with bottom product from said flash absorber, an LNG product outlet in fluid communication with top product from said flash absorber and said demethanizer, and an NGL product outlet in fluid communication with bottom product from said demethanizer, wherein said LNG product outlet is additionally in fluid communication with said flash absorber.

10. Apparatus for recovering natural gas liquids (NGL) from liquid natural gas (LNG), comprising a flash absorber in fluid communication with an LNG inlet, wherein said flash absorber operates at a pressure of less than approximately 210 psia, a demethanizer in fluid communication with bottom product from said flash absorber, an LNG product outlet in fluid communication with top product from said flash absorber and said demethanizer, and an NGL product outlet in fluid communication with bottom product from said demethanizer, wherein said LNG product outlet is additionally in fluid communication with said demethanizer.

11. The apparatus of claim 8, wherein said LNG inlet is additionally in fluid communication with a heat exchanger capable of partially vaporizing LNG from said inlet, and said heat exchanger is in fluid communication with said flash absorber.

12. The apparatus of claim 9, wherein said LNG inlet is additionally in fluid communication with a heat exchanger capable of partially vaporizing LNG from said inlet, and said heat exchanger is in fluid communication with said flash absorber.

13. The apparatus of claim 10, wherein said LNG inlet is additionally in fluid communication with a heat exchanger capable of partially vaporizing LNG from said inlet, and said heat exchanger is in fluid communication with said flash absorber.

14. Apparatus for recovering natural gas liquids (NGL) from liquid natural gas (LNG),comprising a flash absorber in fluid communication with an LNG inlet, a demethanizer in fluid communication with bottom product from said flash absorber, an LNG product outlet in fluid communication with top product from said flash absorber and said demethanizer, and an NGL product outlet in fluid communication with bottom product from said demethanizer, wherein said LNG product outlet is additionally in fluid communication with said flash absorber and said demethanizer, and wherein said bottom product from said flash absorber is in fluid communication with a demethanizer feed preheater, and said demethanizer feed preheater is in fluid communication with said demethanizer.

15. Apparatus for recovering natural gas liquids (NGL) from liquid natural gas(LNG),comprising a flash absorber in fluid communication with an LNG inlet, a demethanizer in fluid communication with bottom product from said flash absorber, an LNG product outlet in fluid communication with top product from said flash absorber and said demethanizer, and an NGL product outlet in fluid communication with bottom product from said demethanizer, wherein said LNG product outlet is additionally in fluid communication with said flash absorber, and wherein said bottom product from said flash absorber is in fluid communication with a demethanizer feed preheater, and said demethanizer feed preheater is in fluid communication with said demethanizer.

16. Apparatus for recovering natural gas liquids (NGL) from liquid natural gas (LNG),comprising a flash absorber in fluid communication with an LNG inlet, a demethanizer in fluid communication with bottom product from said flash absorber, an LNG product outlet in fluid communication with top product from said flash absorber and said demethanizer, and an NGL product outlet in fluid communication with bottom product from said demethanizer, wherein said LNG product outlet is additionally in fluid communication with said demethanizer, and wherein said bottom product from said flash absorber is in fluid communication with a demethanizer feed preheater, and said demethanizer feed preheater is in fluid communication with said demethanizer.

17. The apparatus of claim 8, wherein said top product from said flash absorber is in fluid communication with a compressor, and said compressor is in fluid communication with said LNG product outlet.

18. The apparatus of claim 8, wherein said top product from said flash absorber is in fluid communication with a heat exchanger capable of condensing said top product from said flash absorber, and said heat exchanger is in fluid communication with said LNG product outlet.

19. The apparatus of claim 9, wherein said top product from said flash absorber is in fluid communication with a compressor, and said compressor is in fluid communication with said LNG product outlet.

20. The apparatus of claim 9, wherein said top product from said flash absorber is in fluid communication with a heat exchanger capable of condensing said top product from said flash absorber, and said heat exchanger is in fluid communication with said LNG product outlet.

21. The apparatus of claim 10, wherein said top product from said flash absorber is in fluid communication with a compressor, and said compressor is in fluid communication with said LNG product outlet.

22. The apparatus of claim 10, wherein said top product from said flash absorber is in fluid communication with a heat exchanger capable of condensing said top product from said flash absorber, and said heat exchanger is in fluid communication with said LNG product outlet.

23. The apparatus of claim 8, wherein said top product from said demethanizer is in fluid communication with a heat exchanger capable of condensing said top product from said demethanizer, and said heat exchanger is in fluid communication with said LNG product outlet.

24. The apparatus of claim 9, wherein said top product from said demethanizer is in fluid communication with a heat exchanger capable of condensing said top product from said demethanizer, and said heat exchanger is in fluid communication with said LNG product outlet.

25. The apparatus of claim 10, wherein said top product from said demethanizer is in fluid communication with a heat exchanger capable of condensing said top product from said demethanizer, and said heat exchanger is in fluid communication with said LNG product outlet.

26. The apparatus of claim 8, wherein said LNG product outlet is additionally in fluid communication with a heat exchanger capable of cooling a portion of LNG product, and said heat exchanger is in fluid communication with said flash absorber.

27. The apparatus of claim 9, wherein said LNG product outlet is additionally in fluid communication with a heat exchanger capable of cooling a portion of LNG product, and said heat exchanger is in fluid communication with said flash absorber.

28. The apparatus of claim 8, wherein said LNG product outlet is additionally in fluid communication with a heat exchanger capable of cooling a portion of LNG product, and said heat exchanger is in fluid communication with said demethanizer.

29. The apparatus of claim 10, wherein said LNG product outlet is additionally in fluid communication with a heat exchanger capable of cooling a portion of LNG product, and said heat exchanger is in fluid communication with said demethanizer.

* * * * *